United States Patent [19]

Junkers

[11] Patent Number: 4,671,142

[45] **Date of Patent: * Jun. 9, 1987**

[54] FLUID OPERATED WRENCH

[76] Inventor: John K. Junkers, 7 Arrowhead La., Saddle River, N.J. 07458

[ * ] Notice: The portion of the term of this patent subsequent to Feb. 24, 2004 has been disclaimed.

[21] Appl. No.: 768,038

[22] Filed: Aug. 21, 1985

[51] Int. Cl.[4] ..... B25B 13/06

[52] U.S. Cl. ..... 81/57.39

[58] Field of Search ..... 81/57.36, 57.39, 54

[56] References Cited

U.S. PATENT DOCUMENTS

| | | | |
|---|---|---|---|
| 4,336,727 | 6/1982 | Junkers | 81/57.39 |
| 4,409,865 | 10/1983 | Krautter et al. | 81/57.39 |
| 4,429,597 | 2/1984 | Grabovac et al. | 81/57.39 |
| 4,458,563 | 7/1984 | Bickford et al. | 81/57.39 |

FOREIGN PATENT DOCUMENTS

| | | | |
|---|---|---|---|
| 929426 | 5/1982 | U.S.S.R. | 81/57.39 |

*Primary Examiner*—Frederick R. Schmidt

*Assistant Examiner*—Bradley I. Vaught

*Attorney, Agent, or Firm*—Michael J. Striker

[57] ABSTRACT

A fluid-operated wrench has a support, a ratchet gear turnably mounted on the support, a pair of driving pawls respectively having free ends engagable with the teeth of the ratchet gear, a drive with a driving element reciprocable along a forward and reverse stroke, a transmission between the driving element and the driving pawls and formed so that during the forward stroke one of the pawls turns the ratchet gear in one direction and during the rearward stroke the other of the pawls turns the ratchet gear in the same direction, wherein the transmission includes a driving arm, and the driving pawls are pivotally connected to the driving arm and at the same time guided in elongated curved slots formed as arcs of two circumferences which are described by two different radii with a center on the axis of the ratchet gear. The wrench has a housing accommodating the drive and also having an inner space in which the support together with the other element can be releasably insertable.

10 Claims, 5 Drawing Figures

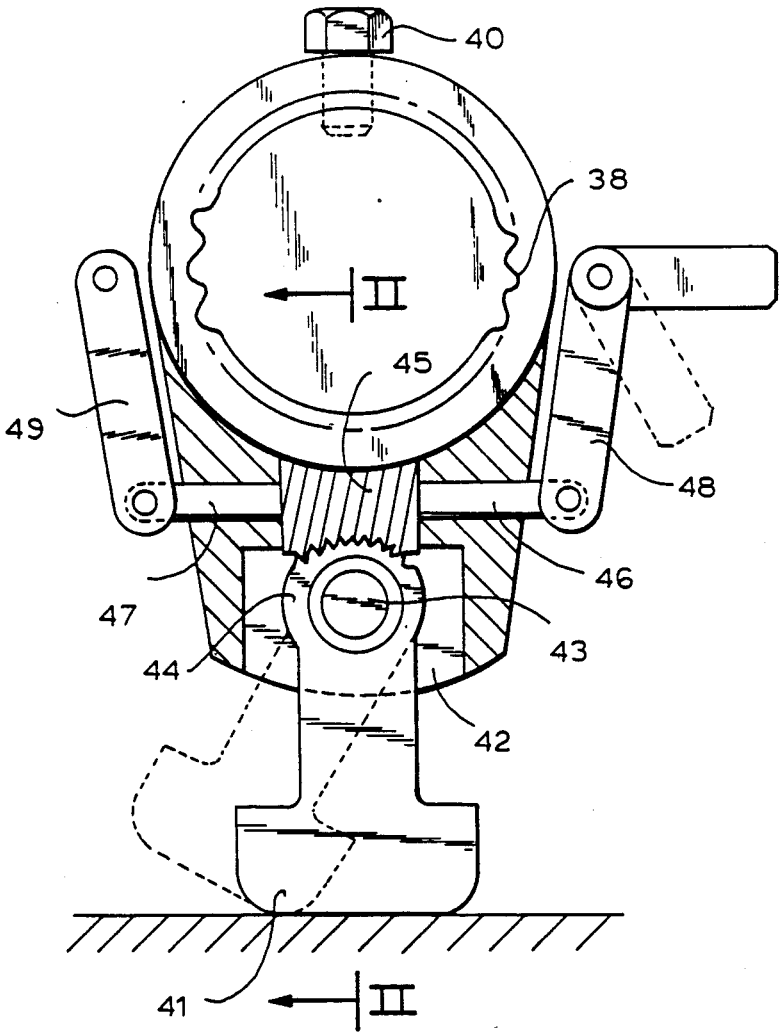
FIG. 4
FIG. 3
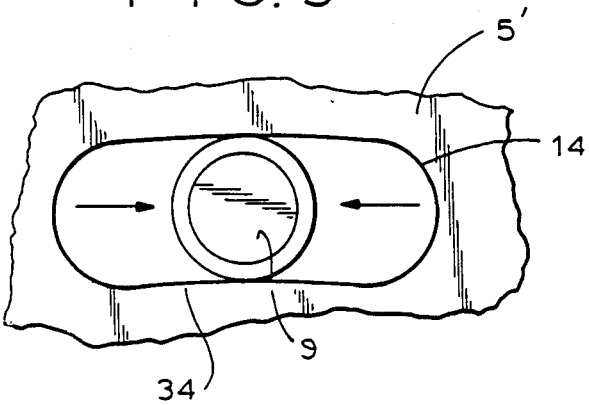

FLUID OPERATED WRENCH

BACKGROUND OF THE INVENTION

The present invention relates to a fluid operated wrench for tightening or loosening threaded connectors.

Fluid operated wrenches of the above mentioned general type are known in the art. One of such wrenches is disclosed in my U.S. Pat. Nos. 4,368,655 and 4,409,865. This hydraulic wrench has a support, a ratchet gear mounted turnably on the support, and a pair of driving pawls which have free ends engaging the teeth of the ratchet gear and are driven from a reciprocable driving element along a forward and a rearward stroke via a transmission. The transmission between the driving element and the drive pawls are constructed and arranged so that during the forward stroke of the driving element one of the driving pawls is moved in a given direction along an active stroke driving the ratchet gear through a given angle and the other of the driving pawls is moved along a return stroke to move in a direction opposite to the given direction over at least one tooth of the ratchet gear, whereas during the rearward stroke of the driving element the other driving pawl is moved along its active stroke and the one driving pawl is moved along its return stroke. When the fluid operated wrench is designed as described herein above, it has a continuous ratchet drive, with which the ratchet gear is turned through predetermined angles during the forward stroke as well as during the return stroke of the driving element.

The disadvantage of this wrench is that the pawls rub against the teeth of the ratchet gear during their active stroke. When the high power is applied this causes early fatigue of the material and breakage of the teeth of the ratchet gear. In addition, the driving pawls change their leverage during their active stroke and therefore cause inaccuracies in excess of the acceptable 5%, which is important for the accuracy of the applied torque. This change in leverage is caused by the movement of the pawls in the tooth of the ratchet gear, which results from the fact that the pawls swing during their active stroke in a direction which deviates from the direction normal to the circumference of the ratchet gear.

It is also known that all high powered fluid operated wrenches have a complicated construction with either a pivotally attached cylinder or a pivotally attached piston rod of the cylinder-piston drive unit. This is necessary because otherwise movements of the lever arm along a path which is curved around its pivot axis and movements of the piston rod along a straight path would cause the rod to bend and to ruin the piston seal. It is also known that wrenches as described above are single-purpose wrenches, usually for limited clearance applications where the reaction point is on the same plane as the tool housing.

SUMMARY OF THE INVENTION

Accordingly it is an object of the present invention to provide a fluid operated hydraulic wrench which avoids the disadvantages of the prior art.

More particularly, it is an object of the present invention to provide a fluid operated wrench in which the rubbing of the pawls against the teeth of the ratchet gear is considerably reduced or eliminated, the accuracy of the applied torque is increased, and is less complicated and expensive cylinder-piston unit can be used.

In keeping with these objects and with others which wil become apparent hereinafter, one feature of the present invention resides, briefly stated, in a fluid-operated wrench which has support means, a ratchet gear mounted turnably about its axis on the support means, a pair of driving pawls respectively having free end engageable with the teeth of the ratchet gear, drive means having a driving element reciprocable along a forward and a reverse stroke, and a transmission provided between the driving element and the driving pawls constructed and arranged so that during the forward stroke of the driving element one of the driving pawls drives the ratchet gear through a given angle at a certain pressure related force and during its rearward stroke the other driving pawl drives the ratchet gear in the same direction, at the same pressure related force due to an engineered increase in leverage to equalize the lower thrust resulting from the smaller rearward piston area, wherein the transmission means includes at least one elongated driving arm pivotable about its pivot axis by the reciprocable driving element, and guiding means is provided which includes two elongated curved slots in the support means extending over two arcs of two concentric circumferences described by two different radii with a center in the axis of the ratchet gear, and the driving pawls are pivotally connected with the driving arm and at the same time are guided respectively in the curved slots during pivoting of the driving arm.

When the fluid operated wrench is designed in accordance with these features, it provides a high torque accuracy and a substantially friction-free cooperation of the driving pawls with the teeth of the ratchet gear.

In accordance with another feature of the present invention, an additional rectilinear slot is provided in the support means and extends in the direction of reciprocation of the driving element or more particularly of a piston rod of a fluid-operated cylinder-piston unit. In this construction it is not necessary to provide a pivotally attached cylinder or a pivotally attached piston rod, and therefore the cylinder-piston unit has a simple and inexpensive construction.

A further feature of the present invention is that the fluid-operated wrench in accordance with the present invention can be constructed to have a housing provided with a cylinder-piston unit, and support means containing a ratchet drive and transmission means for single purpose units usually containing a male square drive member to engage with the stranded impact sockets. It can also be constructed to have a housing provided with a cylinder-piston unit and the support means together with the ratchet gear, the driving pawls, the driving arm and the transmission means is insertable into the interior of the housing and retained in the latter by a snap connection easily disengageable by a user. In this construction it is possible to use the same fluid-operated wrench both as a standard socket-type tool and as a limited clearance-type tool by alternatingly inserting into the housing the respectively constructed inserts.

The novel features of the present invention which are considered as characteristic are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is a view showing a pivot pin of one of driving pawls in accordance with another embodiment of the invention; and FIGS. 4 and 5 are axial and side view of a reaction member attached to a housing.

DESCRIPTION OF A PREFERRED EMBODIMENT

Figure 1:
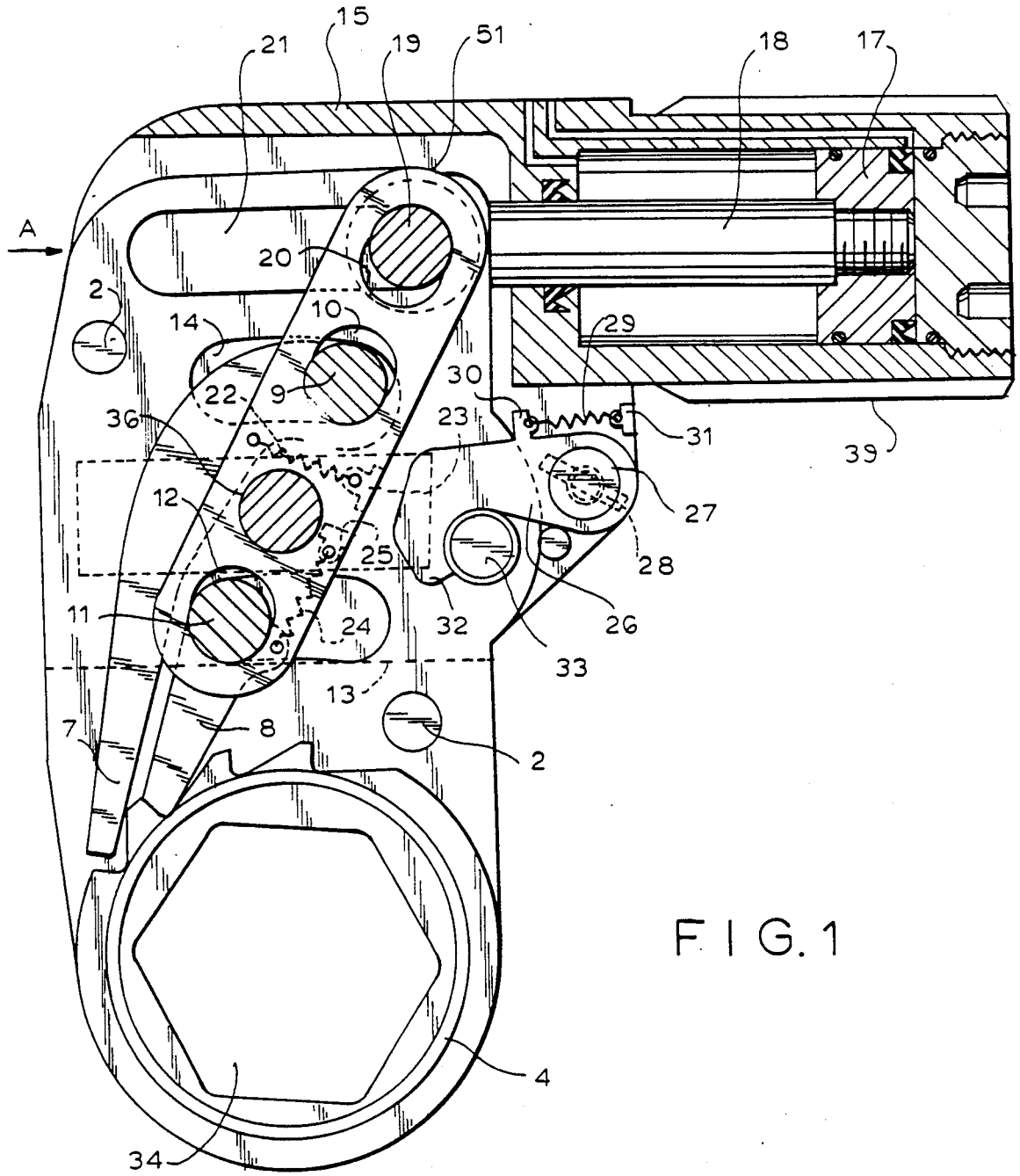
FIG. 1 is a view showing a cross-section of a fluid-operated wrench in accordance with the present invention, taken along the line I—I of the FIG. 2.

A fluid operated wrench in accordance with the present invention, formed for example as a hydraulic wrench, comprises support means including a pair of transversely spaced parallel support plates 1, 1' connected to each other in fixed relationship, for example by spacing pins 2. A ratchet gear 3 is mounted turnably about its axis between the support plates 1, 1'. For this purpose, the ratchet gear is provided with a pair of trunnions 4 projecting at opposite sides of the ratchet gear coaxially therewith and turnably mounted in corresponding bores of the support plates 1 and 1'. A pair of driving arms 5, 5' are sandwiched between opposite faces of the support plates 1, 1'. The driving arms 5, 5' are pivotally connected to the support plates 1, 1' by a pivot pin 6.

The wrench further comprises a pair of driving pawls 7 and 8 respectively having free ends engaging the teeth of the ratchet gear 3. The driving pawl 7 is pivotally carried in the region of the other end thereof on the driving arms 5, 5' by a pivot pin 9 which extends through bores 10 of the driving arms 5, 5'. The bores 10 are elongated in the direction of elongation of the driving arms of 5, 5' and are located at one side of the pivot pin 6. The other driving pawl 8 is pivotally carried in the region of the other end thereof on the driving arms 5, 5' by means of a pivot pin 11 which extends through bores 12 in the driving arms 5, 5'. The bores 12 are also elongated in the direction of elongation of the driving arms 5, 5' and located at the other side of the pivot pin 6.

The support plates 1, 1' are provided with elongated curved slots 13 and 14 which extend along two arcs of two circumferences described by two different radii with a center coinciding with the axis of the ratchet gear 3. The pivot pin 11 also extends through the curved slot 13 of the support plates 1, 1', while the pivot pin 9 also extends through the curved slot 14 of the support plates 1, 1'.

The fluid-operated wrench of the invention further has a one-piece housing with two housing parts 15 and 16. The housing part 15 is U-shaped and formed so that the upper portions of the plates 1, 1' can be inserted into the inner space of the housing part 15, preferably in abutting side-by-side relationship. The housing part 16 forms a cylinder of a fluid-operated cylinder-piston unit, for example a hydraulic cylinder-piston unit. A piston 17 reciprocates in the cylinder of the cylinder-piston unit and is connected to one end of a piston rod 18. The other end of the piston rod 18 is pivotally connected with the driving arms 5, 5' by a pivot pin 19. The pivot pin 19 extends through bores 20 which are elongated in the direction of elongation of the driving arms. The bores 20 are formed in the driving arms 5, 5' located at their ends which are distal from the ratchet gear 3. The support plates 1, 1' are provided with elongated slots 21 which are rectilinear and extend in the direction of reciprocation of the piston rod 18. The pivot pin 19 also extend through the slots 21 of the support plates 1, 1'.

Rollers 34 can be arranged on the pins 9, 11 and 19 for rolling in the respective bores 10, 12 and 20 of the driving arms 5, 5' and the slots 13, 14 and 21 of the support plates 1, 1' to reduce the frictions.

The bores 10, 12, 20 and a bore 36 for the pivot pins 9, 11, 19 and 36 are arranged so that during pivoting of the driving arm the distance between the centers of the pivot pins 19 and 6 changes in equal relation to the change of the distance between the centers of the pivot pins 9 and 11.

Biasing means are provided for biasing the driving pawls 7 and 8 toward the root circle of the ratchet gear. The biasing means can include, as shown in FIG. 1, a coil tension spring 22 engaging with its opposite ends the driving pawl 7 and an abutment 23 projecting from one of the driving arms 5 or 5', and a coil tension spring 24 engaging with its opposite ends the driving pawl 8 and another abutment 25 projecting from one of the drive arms. Conventional means, not shown in the drawing, are provided for alternatingly feeding pressure fluid, for instance, oil under pressure, into the cylinder of the cylinder-piston unit to opposite sides of the piston 17 therein, respectively discharging pressure fluid therefrom.

A catch 26 is pivotally mounted in the housing by means of a pivot pin 27 which can extend through bores of the housing part 15. The pin 27 is fixed with the catch 26 and provided at at least one end with a groove 28 for the purpose which will be explained herein below. A compression spring 29 engages with its opposite ends an abutment 30 of the catch 26 and an abutment 31 of the housing. The catch 26 has a hook-shaped portion 32 which is spaced from the pin 27, and the housing is provided with a pin 33 for cooperation with the hook-shaped portion.

The wrench in accordance with the present invention can be used for many purposes. A preferred use is to tighten or loosen a threaded connection. For the purpose, the trunnions 4 and the ratchet gear 3 are formed with a coaxial polygonal, for example hexagonal, passage 34 therethrough for engagement with the head of a threaded connection to be turned.

The operation of the above described wrench will be obvious from the description thereof. During the forward stroke of the piston 17 the piston rod 18 moves to the left in FIG. 1, the driving arms 5, 5' are turned in counterclockwise direction, the driving pawl 7 will drive the ratchet gear through a given angle in clockwise direction, whereas the driving pawl 8 will move backwards over a tooth of the ratchet gear. During the following return stroke of the piston 17, the piston rod 18 moves to the right, the driving arms 5, 5' are turned in clockwise direction, the driving pawl 8 will move the ratchet gear through a given angle in the same clockwise direction, whereas the driving pawl 7 will move back over a tooth of the ratchet gear. Since the opposite ends of the pawls 7 and 8 are connected with the driving arms 5, 5' by pins 9, 11 extending through the elongated bores 10, 12 and displaceable in the curved slots 14, 13, the free ends of the driving pawls coöperate with the teeth of the ratchet gear in substantially friction free manner and the leverage of the driving pawls does not change during their active stroke. Since the pin 19 moves in the rectilinear slot 21 and in the elongated bore 20, the piston rod 18 performs exactly rectilinear movement which makes unnecessary pivotal attachment of the cylinder or the piston rod, and at the same time does not affect the piston seal.

Figure 2:
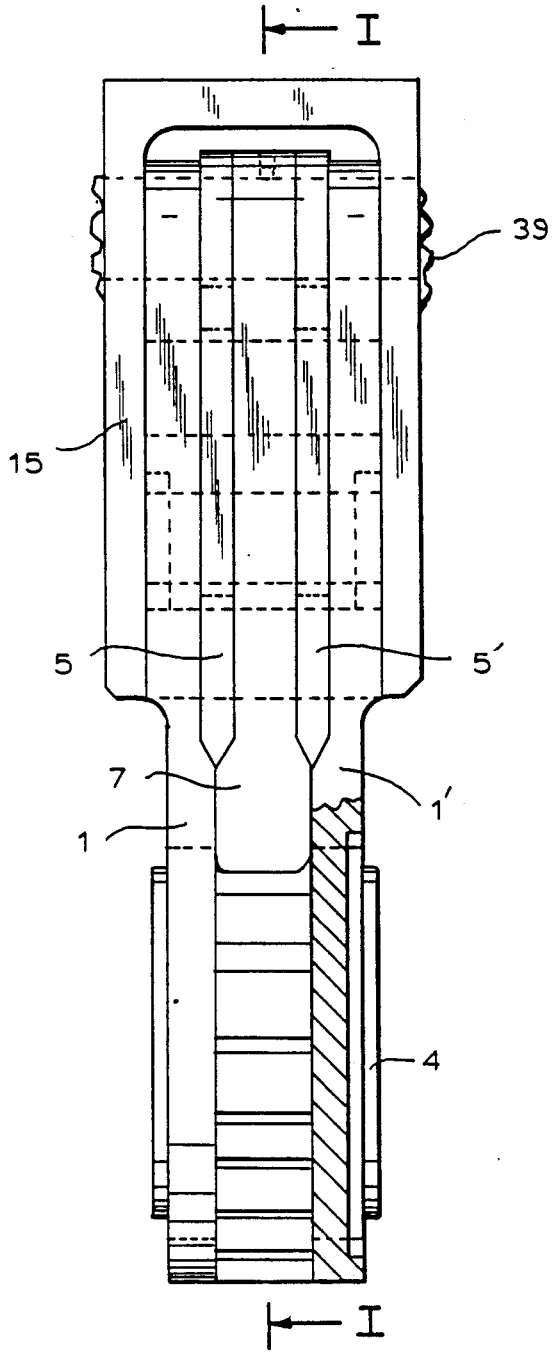
FIG. 2 is is a front view of the inventive fluid-operated wrench, as viewed in the direction of the arrow A of FIG. 1.

The wrench shown in the drawings comprises the support plates 1, 1' and the ratchet gear 3 formed so that it can be used as a limited clearance-type tool. As can be seen from FIG. 2, the axial distance between the outer surfaces of the lower portion of the support plates 1, 1' is small and therefore the ratchet gear can be introduced into narrow clearances. In order to use the wrench in accordance with the present invention as a standard socket-type tool, a screwdriver or another member can be inserted into the slot 28 of the pin 27 so as to turn the pin and the catch 26 connected therewith in clockwise direction in FIG. 1 and therefore disengage the hook-shaped portion 32 of the catch from the pin 33. Then the plates 1, 1' together with the driving arms 5, 5', the driving pawls 7, 8 and the ratchet gear 3 can be easily withdrawn from the inner space of the housing portion 15. Before the withdrawal the piston rod 18 must be disconnected from the driving arms 5, 5', for which purpose the pin 19 is formed so that it extends through bores provided in the lateral walls of the housing portion 15 and is removed by pushing in the axial direction of the pin.

For operating the inventive wrench as a standard socket-type tool, the lower part of the plates 1, 1' must be formed differently and provided with sockets. This is known and therefore not shown in the drawing. These socket-type plates together with the driving arms 5, 5' and the driving pawls 6, 7 are inserted into the space in the housing portion 15, and the hook-shaped portion 32 of the catch 26 snaps over the pin 33 under the action of the compression spring 29. Then the pin 19 is inserted for connecting the piston rod 18 with the driving arms 5, 5'. It is therefore clear that the inventive fluid-operated wrench can be easily converted from a limited clearance-type tool to a standard socket-type tool, and vice versa.

Figure 5:
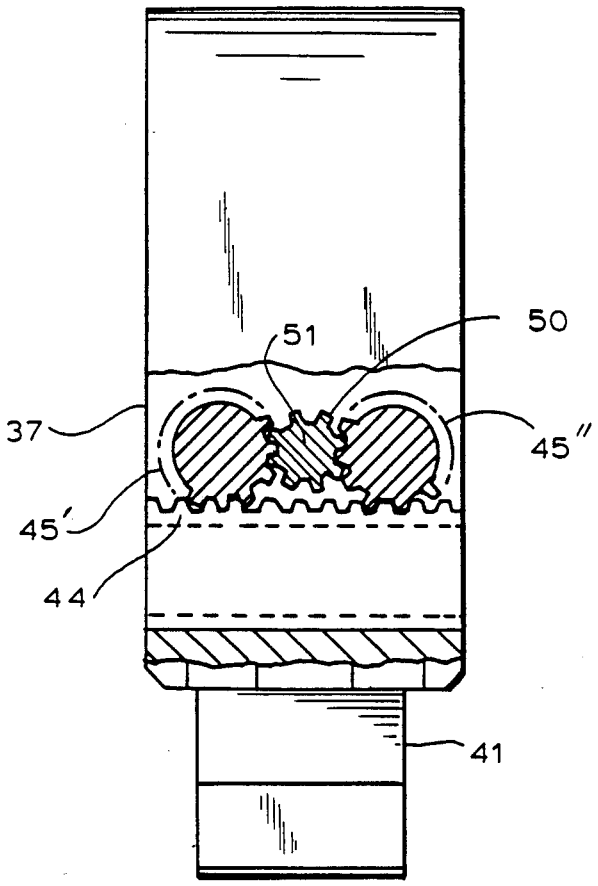

FIGS. 4 and 5 show a reaction member which can be attachable to the housing of the wrench in accordance with the present invention. It has a casing 37 provided with inner splines 38 which are engageable with outer splines 39 of the housing part 16. A bolt 40 secures the casing 37 on the housing part 16. An abutment member 41 is pivotally mounted in a groove 42 of the casing 37 by a pivot pin 43. The pivot pin 43 extends through a bore in the abutment 41 and more particularly in its portion which is formed as a worm gear 44. At least one worm 45 is turnably mounted in the casing 37 and its teeth engage the teeth of the worm gear 44. The worm 45 has two shaft portions 46 and 47 at its both axial ends. The shaft portions 46 and 47 are connected with cranks 48 an 49.

When for example the wrench in accordance with the present invention is used for engaging a polygonal head of a threaded connector to be turned, during such turning of a threaded connector in one direction a force is created tending to turn the housing in an opposite direction. The abutment member 41 of the reactor engages a periphery of a flange in which the threaded connector is to be turned and counteracts the above mentioned force.

If the ratchet gear is stuck due to increased torsion in the threaded connector which is opposite to the turning of the ratchet gear during the active stroke and due to the reaction forces acting on the wrench, the wrench in accordance with the invention can be released by displacing the abutment member 41 in the respective direction and therefore disengaging the abutment member 41 from for example the flange. This can be done simply by turning of a respective one of the cranks 47, 48, whereby the worm 45 is turned via the shaft portions 46, 47 and turns the abutment member 41 in the required direction. It is no longer necessary to at least partially destroy the reaction member, as in the known fluid-operated wrenches.

It is to be understood that other types of engagement between the housing 37 and the abutment member 41 can be provided to allow loosening of the abutment member 41. The reaction member can have only one crank, and moreover other means for turning the worm 45 can be provided in it.

FIG. 5 shows another embodiment of the reaction member in accordance with the invention. The worm gear 44 is here in engagement with two worms 45' and 45'' which are spaced from one another in the axial direction of the worm gear. The worms 45' and 45'' engage with an intermediate gear 50 having a shaft portion 51. A not-shown crank which can be similar to the cranks 48, 49 is connected with the shaft portion 51. When the not-shown crank is rotated, for example manually by a user, both worms 45' and 45'' are rotated in the same direction and turn the worm 44 and therefore the abutment member in the required direction for loosening of the abutment member 41 from a flange or the like against which it has been stuck.

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated wrench, comprising support means; a ratchet gear mounted on said support means turnably about its axis and having a plurality of teeth; a pair of driving pawls respectively having free ends engageable with said teeth of said ratchet gear; drive means having a driving element reciprocating along a forward and a rearward stroke; and transmission means between said driving element and said driving pawls constructed and arranged for moving during the forward stroke of said driving element one of the drive pawls in a given direction along an active stroke driving said ratchet gear through a given angle and the other of said driving pawls along a return stroke to move in a direction opposite to said given direction over at least one tooth of the ratchet gear, and to move during the rearward stroke of said driving element said other driving pawl along its active stroke and said one driving pawl along its retutn stroke, said transmission means including at least one elongated driving arm pivotable about its pivot axis and pivotally connected with said reciprocable driving element so that during reciprocation of the latter said driving arm is pivoted about said pivot axis; and guiding means provided in said support means and including two elongated curved guides extending over two arcs of two concentric circumferences described by two different radii with a center on said axis of said ratchet gear, said driving pawls being pivotally connected with said at least one driving arm and guided respectively in said curved guides during pivoting of said driving arm so that during the active stroke said free ends of said driving pawls do not move relative to said teeth of said ratchet gear and therefore maintain a constant and friction-free leverage upon said teeth of said ratchet gear.

2. A fluid-operated wrench as defined in claim 1, wherein said reciprocable driving element has an axis and reciprocates in an axial direction; and further comprising a pin connecting said reciprocable element with said driving arm, said support means having a rectilinear slot extending in the direction of reciprocation of said reciprocable element, said pin connecting said reciprocable element with said driving arm being guided in said rectilinear slot.

3. A fluid-operated wrench as defined in claim 1; and further comprising two pivot pins each pivotally connecting a respective one of said driving pawls with said driving arm, and a roller arranged on each of said pins for rolling in a respective one of said elongated guides of said support means.

4. A fluid-operated wrench as defined in claim 1; and further comprising a housing having a first housing portion which accomodates said drive means, and a second housing portion having an inner space, said support means together with said ratchet gear, said driving arm and said driving pawls being insertable into said inner space of said second housing portion and withdrawable form said inner space.

5. A fluid operated-wrench, comprising support means; a ratchet gear mounted on said support means turnably about its axis and having a plurality of teeth; a driving pawl having a free end engageable with said teeth of said ratchet gear; drive means having a driving element reciprocable along a forward and a rearward stroke; and transmission means between said driving element and said driving pawl constructed and arranged for moving during the power stroke of said driving element said drive pawl in a given direction along an active stroke driving said ratchet gear through a given angle and to move during the reverse stroke of said driving element said driving pawl along a return stroke to move in a direction opposite to said given direction over at least one tooth of the ratchet gear, said transmission means including at least one elongated driving arm pivotable about its pivot axis and pivotally connected with said reciprocable driving element so that during reciprocation of the latter said driving arm is pivoted about said pivot axis; and guiding means provided in said support means including one elongated curved guide extending over one arc of one concentric circumference described by one radius with a center on said axis of said ratchet gear, said driving pawl being pivotally connected with said at least one driving arm and guided in said curved guide during pivoting of said driving arm so that during the active stroke said free end of said driving pawl does not move relative to said teeth of said ratchet gear and therefore maintains a constant and friction-free leverage upon said teeth of said ratchet gear.

6. A fluid-operated wrench, comprising support means; a ratchet gear mounted on said support means turnably about its axis and having a plurality of teeth; a pair of driving pawls respectively having free ends engageable with said teeth of said ratchet gear; drive means having a driving element reciprocable along a forward and a rearward stroke; and transmission means between said driving element and said driving pawls constructed and arranged for moving during the forward stroke of said driving element one of the drive pawls in a given direction along an active stroke driving said ratchet gear through a given angle and the other of said driving pawls along a return stroke to move in a direction opposite to said given direction over at least one tooth of the ratchet gear, and to move during the rearward stroke of said driving element said other driving pawl along its active stroke and said one driving pawl along its return stroke, said transmission means including at least one elongated driving arm pivotable about its pivot axis and pivotally connected with said reciprocable driving element so that during reciprocation of the latter said driving arm is pivoted about said pivot axis; and guiding means provided in said support means and including two elongated curved guides extending over two arcs of two concentric circumferences described by two different radii with a center on said axis on said ratchet gear, said driving pawls being pivotally connected with said at least one driving arm and guided respectively in said curved guides during pivoting of said driving arm, said driving arm having two bores which are elongated in direction of elongation of said driving arm so that during pivoting of said driving arm said driving pawls are guided in said elongated bores.

7. A fluid-operated wrench as defined in claim 6; and further comprising two pivot pins each provided on a respective one of said driving pawls at an end which is opposite to its free end, each of said pins extending through a respective one of said elongated guides of said support means and a respective one of said elongated bores of said driving arm.

8. A fluid-operated wrench as defined in claim 6; and further comprising two pins each pivotally connecting a respective one of said driving pawls with said driving arm, and a roller arranged on each of said pins for rolling in said elongated guides of said support means and in said elongated bores of said driving arm.

9. A fluid-operated wrench, comprising support means; a ratchet gear mounted on said support means turnably about its axis and having a plurality of teeth; a pair of driving pawls respectively having free ends engageable with said teeth of said ratchet gear; drive means haivng a driving element reciprocable along a forward and a rearward stroke; and transmission means between said driving element and said driving pawls constructed and arranged for moving during the forward stroke of said driving element one the drive pawls in a given direction along an active stroke driving said ratchet gear through a given angle and the other of said driving pawls along a return stroke to move in a direction opposite to said given direction over at least one tooth of the ratchet gear, and to move during the rearward stroke of said driving element said other driving pawl along its active stroke and said one driving pawl along its return stroke, said transmission means including at least one elongated driving arm pivotable about its pivot axis and pivotally connected with said reciprocable driving element so that during reciprocation of the latter said driving arm is pivoted about said pivot axis; guiding means provided in said support means and including two elongated curved guides extending over two arcs of two concentric circumferences described by two different radii with a center on said axis of said ratchet gear, said driving pawls being pivotally connected with said at least one driving arm and guided respectively in said curved guides during pivoting of said driving arm; a housing having a first housing portion which accomodates said drive means, and a second housing portion having an inner space, said support means together with said ratchet gear, said driving arm and said driving pawls being insertable into said inner space of said second housing portion and withdrawable from said inner space; and means for releasably holding said support means in said inner space of said second housing part, said holding means including a formation provided on one of said second housing part and said support means, and a catch provided on the other of said second housing part and said support means and operating for engaging said formation with a snap action for holding said support means in said second housing part, and disengaging from said formation for removing said support means from said second housing part.

10. A fluid-operated wrench as defined in claim 9; and further comprising spring biasing means arranged to bias said catch toward engagement with said formation.

* * * * *